US007240527B2

(12) United States Patent
Boyd

(10) Patent No.: US 7,240,527 B2
(45) Date of Patent: Jul. 10, 2007

(54) KEY TURNING DEVICE

(76) Inventor: Terry M. Boyd, 163 Sir Rogers Ct., Gilbertsville, KY (US) 42044

( * ) Notice: Subject to any disclaimer, the term of this patent is extended or adjusted under 35 U.S.C. 154(b) by 0 days.

(21) Appl. No.: 11/103,791

(22) Filed: Apr. 12, 2005

(65) Prior Publication Data

US 2007/0056340 A1 Mar. 15, 2007

(51) Int. Cl.
*E05B 19/00* (2006.01)
*A47G 29/10* (2006.01)

(52) U.S. Cl. ..... 70/456 R; 70/429; 70/459

(58) Field of Classification Search ..... 70/408, 70/456 R, 456 B, 459, 429, 430; 16/422, 16/426, 430; 81/58, 60
See application file for complete search history.

(56) References Cited

U.S. PATENT DOCUMENTS

| | | | | | |
|---|---|---|---|---|---|
| 4,035,865 | A | | 7/1977 | McRae et al. | |
| 4,475,367 | A | * | 10/1984 | Raitto | 70/456 R |
| 4,557,124 | A | * | 12/1985 | Russ | 70/456 R |
| 4,583,383 | A | | 4/1986 | Bosco et al. | |
| 4,597,478 | A | * | 7/1986 | Bodnar | 81/62 |
| D286,465 | S | | 11/1986 | Attwood | |
| 4,631,770 | A | * | 12/1986 | Goldberg | 70/456 R |
| D292,771 | S | * | 11/1987 | Kim | D8/25 |
| 4,791,837 | A | * | 12/1988 | Main | 81/63.1 |
| 4,910,983 | A | | 3/1990 | Taylor | |
| 4,991,417 | A | | 2/1991 | Grecco | |
| 5,058,465 | A | | 10/1991 | Womack | |
| 5,207,082 | A | | 5/1993 | LeMaitre | |
| 5,440,910 | A | | 8/1995 | Florian | |
| 5,667,441 | A | * | 9/1997 | Parsons | 70/456 R |
| 5,671,624 | A | * | 9/1997 | Sivils | 70/408 |
| 5,794,471 | A | | 8/1998 | Rizzo | |
| 5,887,468 | A | * | 3/1999 | Hasan | 70/456 R |
| 6,079,298 | A | * | 6/2000 | Gasperi et al. | 81/60 |
| 6,138,531 | A | * | 10/2000 | Lamons | 81/60 |
| 6,164,102 | A | | 12/2000 | Gapco | |
| 6,286,395 | B1 | * | 9/2001 | Frazier | 81/60 |
| 6,598,438 | B2 | | 7/2003 | Ashby | |

* cited by examiner

*Primary Examiner*—Suzanne Dino Barrett
*Assistant Examiner*—Christopher Boswell
(74) *Attorney, Agent, or Firm*—Carrithers Law Office, PLLC; David W. Carrithers

(57) ABSTRACT

A device to facilitate manipulating a key by persons having restricted finger and/or hand use that includes a key holding unit with a socket in one end thereof and means to removably secure a key to such unit. The device also includes a hand tool that has a hand grippable body portion with a rounded outer surface in which there is located finger engageable indentations. The indentations are spaced apart from one another around an outer peripheral portion of the body to facilitate gripping and turning the same. A shaft projects outwardly from the body a terminating in a rounded bullet like free outer end that facilitates inserting the same into the socket in the key holding unit. The shaft has a portion proximate the rounded end that is non circular in outline cross sectional shape that is matingly insertable into the socket in the key holding unit. For those having limited hand movement there is provided a reversible ratchet between the hey holding unit and the hand tool.

16 Claims, 1 Drawing Sheet

KEY TURNING DEVICE

FIELD OF INVENTION

This invention relates generally to a device intended for use by persons that have limited strength and/or infirmities affecting usage of their hands, e.g. the elderly and infirm, making it difficult for them to grasp small objects such as a key or turn the key to lock or unlock a door and more particularly to a hand tool that has a rounded hand grippable body with finger engageable indentations spaced apart from one another about an outer peripheral surface of the body and wherein the hand tool detachably drivingly connects to a key holding unit.

BACKGROUND OF INVENTION

Persons afflicted with arthritis in their finger joints often find it difficult to grasp or turn a key (or turn it far enough) to lock or unlock for example a door to their place of residence. For these people as well as others with other medical or physical afflictions there is need for a simple to use device to help them with their task. A search of the prior art on this subject uncovered the following patents: U.S. Pat. No. 4,910,983 issued in 1990 entitled "Key Turning and Starter Switch Assistance Device"; U.S. Pat. No. 6,598,438 issued in Jul. of 2003 entitled "Key Wrench"; U.S. Pat. No. 5,794,471 issued Aug. of 1998 entitled "Holder for key including Key Turner"; U.S. Pat. No. 4,991,417 issued in Feb. of 1991 entitled "Key extension for the Physically Impaired"; U.S. Pat. No. 4,583,383 issued in Apr. of 1996 entitled "Key Turning Device"; and U.S. Pat. No. 4,035,865 issued in July of 1977 entitled "Implements Useable by Persons Afflicted with Arthritis".

SUMMARY OF INVENTION

A device to facilitate manipulating a key by persons having restricted finger and/or hand use that includes a key holding unit with a socket in one end thereof and means to removably secure a key to such unit. The device also includes a hand tool that has a hand grippable body portion with a rounded outer surface in which there is located finger engageable indentations. The indentations are spaced apart from one another around an outer peripheral portion of the body to facilitate gripping and turning the same. A shaft projects outwardly from the body a terminating in a rounded bullet like free outer end that facilitates inserting the same into the socket in the key holding unit. The shaft has a portion proximate the rounded end that is non circular in outline cross sectional shape that is matingly insertable into the socket in the key holding unit. For those having limited hand movement there is provided a reversible ratchet between the hey holding unit and the hand tool.

A principal object of the present invention is to provide a key turning hand tool that is easily grasped, gripped and turned.

In keeping with the forgoing object there is provided is provided a device to facilitate manipulating a key by persons having restricted finger and/or hand use. More particularly, the device includes a key holding unit having a socket in one end thereof to drivingly receive therein an end portion of a shaft of a hand tool. Means to securely attach a key to the unit are included and a hand tool having a hand grippable body portion with a rounded outer surface. Finger engageable indentations in the body portion are disposed in spaced apart relation relative to one another around an outer peripheral portion thereof to facilitate gripping and turning the same. A shaft projecting from the body that terminates in a rounded bullet like free outer end facilitating inserting the end of the shaft into the socket in the key holding unit. The shaft has a portion proximate the rounded end that has a non circular in outline cross sectional shape that is matingly insertable into the socket for drivingly connecting the hand tool to the key holding unit. For those persons having limited hand movement a reversible ratchet is in a driving manner interposed between the hand grippable body and the key holder unit permitting turning the key by small incremental oscillatory movement of the hand grippable body. The ratchet unit maybe a separate unit or incorporated in the body of the hand tool.

BRIEF DESCRIPTION OF THE DRAWINGS

A better understanding of the present invention will be had upon reference to the following description in conjunction with the accompanying drawings in which like numerals refer to like parts throughout the several views and wherein.

DETAILED DESCRIPTION OF PREFERRED EMBODIMENT

Figure 1:
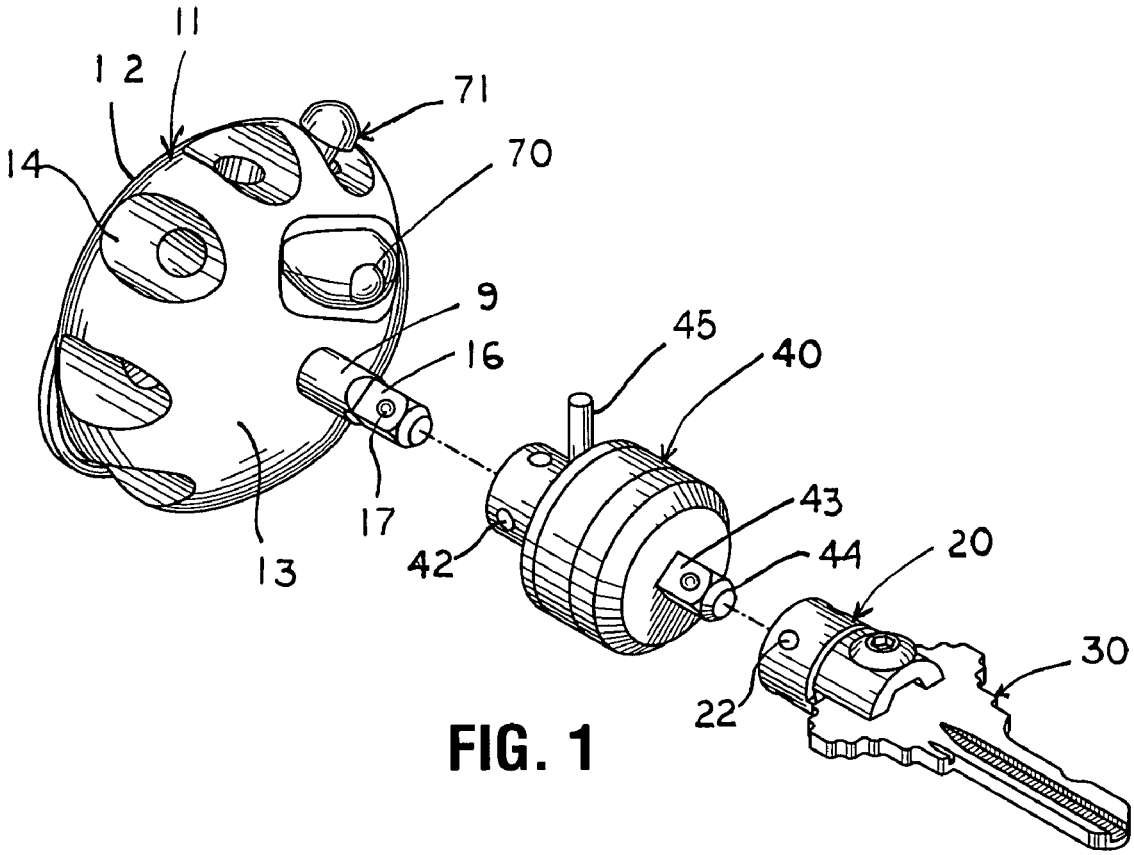
FIG. 1 is an exploded oblique view illustrating components of a key turning apparatus provided in accordance with the present invention.
Figure 2:
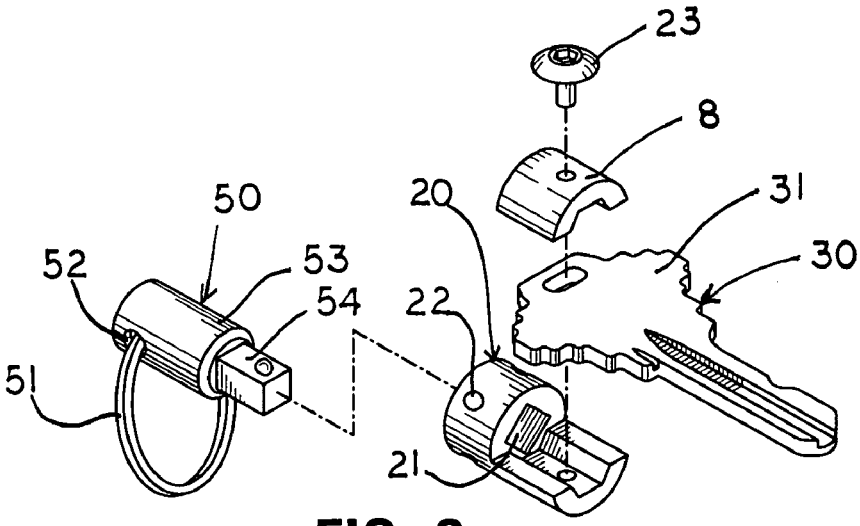
FIG. 2 is an oblique exploded view of the key and key holder portion of the device.

Applicants key turning device includes a hand tool 10 having a generally rounded hand grippable body 11 that is detachably drivingly connectable to a key holding unit 20. A key 30 is detachably securable to the key holding unit 20. A key ring holder unit 50 is provided to which a key holder can be detachably connected and there maybe one for each of the users keys.

The hand tool 10 has a hand grippable body portion 11 is so shaped and sized as to be readily grasped in one's hand taking into account the device is intended primarily for use by those suffering from arthritic finger joints or those with muscular or other afflictions making it difficult to grasp and turn a key. The body portion 11 has a generally flat rear face 12, a generally spherical front face 13 and finger engageable indentations 14 spaced apart from one another around an outer generally circular peripheral portion of the body.

A shaft 9 projects outwardly from the front face 13 of the body terminating in a rounded i.e. bullet shaped leading end 15, (or otherwise suitably shaped), so as facilitate inserting the end of the shaft into a socket in the key holder 20, or a ratchet device 40 to be described hereinafter, as the case maybe. There is a square in cross-sectional shape portion 16 proximate the end of the shaft 14 in which there is located at least one spring loaded ball 17 conventionally used in socket wrench shafts. The ball fits into an indentation or end of a hole (22, 42) in a wall of the socket to releasably retain the shaft in the socket.

The key holder 20 is a short length of a shaft having a socket 21 extending there into and which corresponds in outline shape to the outline cross-sectional shape of the portion 16 of shaft 14. A portion of the short length of shaft is split longitudinally providing a plate 8 that is removably attached to the key holder main body portion by a screw 23 to clampingly retain therebetween the head end portion 31 of the key 30. While the socket 21 is illustrated as extending longitudinally through the short length of shaft it need only extend a short distance inwardly into the shaft from one end thereof.

Optionally there is provided a ratchet unit 40 shown in the drawing as a separate unit. The unit for example maybe one available commercially from the Snap On Tool Company and identified as part number T67A with some modifications thereto. One of the modifications includes having a hole 42 in each of the four faces of the square shaped socket in one end thereof. The opposite end of the ratchet unit has a shaft 43 projecting therefrom in axial alignment with the socket in the opposite end and is modified to terminate in a rounded free outer end 44 (or otherwise suitably shaped) to facilitate insertion of the same into the socket 21 in the key holder 20. The ratchet unit has a lever 45 projecting beyond the body of the ratchet unit so as to be readily engaged by a finger to move it from one position to another to change the direction of rotation of the shaft 43.

The ratchet unit, obviously if so desired, maybe incorporated in the body portion of the hand tool and be drivingly connected to the shaft 14 projecting therefrom.

The hand tool can if desired be provided with a flash light that has a light emitting bulb 70 in the front face 13 of the body so as to selectively emit light that is directed toward the key hole when using the device. A switch 71 is located in one of the finger engageable indentations in the body of the hand tool. A battery compartment (not shown) can be located in the body of the hand tool in any well known and obvious manner with access thereto though a removable cover.

The key ring holder 50 includes a known key split ring 51 looped through a hole 52 in a short length of shaft 53 that has a socket fitting squared end 54. For storage this squared end can be inserted into a socket (not shown) in the rear face 12 of the hand tool body. This is diagrammatically represented by showing a portion of a split ring 51.

The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

I claim:

1. A device to facilitate manipulating a key by persons having restricted finger and/or hand use, said device comprising:

a key holding unit having a socket in one end thereof and means to removably attach a key to said unit;

a hand tool having a hand grippable body that includes a rounded outer surface with finger engageable indentations therein, said indentations being are spaced apart from one another around an outer peripheral portion of said body to facilitate gripping and turning the same;

said body having a shaft projecting therefrom that terminates in a rounded bullet like free outer end facilitating inserting the same into said socket in said key holding unit;

said shaft having a portion proximate said rounded end that has a non circular in outline cross sectional shape that is matingly insertable into said socket;

including a reversible ratchet drivingly interposable between said hand tool and said key holder unit;

said reversible ratchet including a lever projecting beyond said tool body of said reversible ratchet so as to be readily engaged by a finger to move it from one position to another to change the direction of rotation of said shaft; and said key holding unit comprising a short length of a shaft having a socket extending there into corresponding in outline shape to the outline cross-sectional shape of a first portion of said shaft and having a short length second portion of said the short length of said shaft being split longitudinally providing a plate removably attached to said key holding unit by means of retaining there between a head end portion of said key.

2. The device as defined in claim 1 wherein said tool body has a generally flat rear face and a rounded front face and wherein said shaft projects from said front face.

3. The device as defined in claim 2 wherein said front face is generally spherical.

4. The device as defined in claim 1 wherein said ratchet is a separate unit detachably connectable to said shaft and to said key holding unit.

5. The device as defined in claim 1, further comprising a flash light including a light emitting bulb disposed in a front face of said tool body so as to selectively emit light that is directed toward a key hole when using the device, a switch disposed in a finger engageable indentation in said tool body, and a battery in electrical communication with said light emitting bulb disposed in a compartment having a removable cover in said body.

6. A device to facilitate manipulating a key by persons having restricted finger and/or hand use, said device consisting essentially of:

a key holding unit having a socket in one end thereof and means to removably attach a key to said unit;

a hand tool having a hand grippable body that includes a rounded outer surface with finger engageable indentations therein, said indentations being are spaced apart from one another around an outer peripheral portion of said body to facilitate gripping and turning the same;

said body having a shaft projecting therefrom that terminates in a rounded bullet like free outer end facilitating inserting the same into said socket in said key holding unit;

said shaft having a portion proximate said rounded end that has a non circular in outline cross sectional shape that is matingly insertable into said socket;

including a reversible ratchet drivingly interposable between said hand tool and said key holder unit;

said reversible ratchet including a lever projecting beyond said tool body of said reversible ratchet so as to be readily engaged by a finger to move it from one position to another to change the direction of rotation of said shaft; and said key holding unit comprising a short length of a shaft having a socket extending there into corresponding in outline shape to the outline cross-sectional shape of a first portion of said shaft and having a short length second portion of said the short length of said shaft being split longitudinally providing a plate removably attached to said key holding unit by means of retaining there between a head end portion of said key.

7. The device as defined in claim 6 wherein said tool body has a generally flat rear face and a rounded front face and wherein said shaft projects from said front face.

8. The device as defined in claim 7 wherein said front face is generally spherical.

9. The device as defined in claim 6 wherein said ratchet is a separate unit detachably connectable to said shaft and to said key holding unit.

10. The device as defined in claim 6, further comprising a flash light including a light emitting bulb disposed in a front face of said tool body so as to selectively emit light that is directed toward a key hole when using the device, a switch disposed in a finger engageable indentation in said tool body, and a battery in electrical communication with said light emitting bulb disposed in a compartment having a removable cover in said body.

11. A device to facilitate manipulating a key by persons having restricted finger and/or hand use, said device comprising:

a key holding unit having a socket in one end thereof and means to removably attach a key to said unit;

a hand tool having a hand grippable body that includes a rounded outer surface with finger engageable indentations therein, said indentations being are spaced apart from one another around an outer peripheral portion of said body to facilitate gripping and turning the same;

said body having a shaft projecting therefrom that terminates in a rounded bullet like free outer end facilitating inserting the same into said socket in said key holding unit;

said shaft having a portion proximate said rounded end that has a non circular in outline cross sectional shape that is matingly insertable into said socket;

including a reversible ratchet drivingly interposable between said hand tool and said key holder unit;

said reversible ratchet including means projecting beyond said tool body of said reversible ratchet so as to be readily engaged by a finger to move it from one position to another to change the direction of rotation of said shaft; and said key holding unit comprising a short length of a shaft having a socket extending there into corresponding in outline shape to the outline cross-sectional shape of a first portion of said shaft and having a short length second portion of said the short length of said shaft being split longitudinally providing a plate removably attached to said key holding unit by means of retaining there between a head end portion of said key.

12. The device of claim 11, wherein said means projecting beyond said tool body is a lever.

13. The device as defined in claim 11 wherein said tool body has a generally flat rear face and a rounded front face and wherein said shaft projects from said front face.

14. The device as defined in claim 12 wherein said front face is generally spherical.

15. The device as defined in claim 11 wherein said ratchet is a separate unit detachably connectable to said shaft and to said key holding unit.

16. The device as defined in claim 11, further comprising a flash light including a light emitting bulb disposed in a front face of said tool body so as to selectively emit light that is directed toward a key hole when using the device, a switch disposed in a finger engageable indentation in said tool body, and a battery in electrical communication with said light emitting bulb disposed in a compartment having a removable cover in said body.

* * * * *